US009073383B2

(12) United States Patent
Harvey et al.

(10) Patent No.: US 9,073,383 B2
(45) Date of Patent: Jul. 7, 2015

(54) HEAT TRANSFER LABEL VARIABLE DATA INDICATOR AND METHOD OF MAKING SAME

(75) Inventors: Roger M. Harvey, Novi, MI (US); Warren K. Smith, III, Charleston, SC (US)

(73) Assignee: Illinois Tool Works Inc., Glenview, IL (US)

( * ) Notice: Subject to any disclaimer, the term of this patent is extended or adjusted under 35 U.S.C. 154(b) by 615 days.

(21) Appl. No.: 12/414,182

(22) Filed: Mar. 30, 2009

(65) Prior Publication Data

US 2009/0304954 A1 Dec. 10, 2009

Related U.S. Application Data

(60) Provisional application No. 61/059,545, filed on Jun. 6, 2008, provisional application No. 61/138,605, filed on Dec. 18, 2008.

(51) Int. Cl.

| | |
|---|---|
| ***B44C 1/22*** | (2006.01) |
| ***B44C 3/00*** | (2006.01) |
| ***B44C 1/17*** | (2006.01) |
| ***B44C 3/08*** | (2006.01) |
| *B44C 1/24* | (2006.01) |
| *B41M 5/24* | (2006.01) |

(52) U.S. Cl.

CPC ..... *B44C 3/005* (2013.01); *B41M 5/24* (2013.01); *B44C 1/1712* (2013.01); *B44C 1/22* (2013.01); *B44C 3/082* (2013.01)

(58) Field of Classification Search

USPC ..... 264/138, 139, 132, 447; 156/234, 235, 156/241, 277; 427/264, 277

See application file for complete search history.

(56) References Cited

U.S. PATENT DOCUMENTS

| | | | | |
|---|---|---|---|---|
| 4,643,789 | A * | 2/1987 | Parker et al. | 156/219 |
| 5,288,358 | A * | 2/1994 | Logan | 156/268 |
| 6,581,973 | B2 * | 6/2003 | Levine et al. | 283/81 |
| 6,991,259 | B2 * | 1/2006 | Schwarzbauer et al. | 283/62 |
| 7,014,895 | B1 | 3/2006 | Grotefend et al. | |

(Continued)

FOREIGN PATENT DOCUMENTS

| | | |
|---|---|---|
| CN | 1890084 | 1/2007 |
| DE | 4134271 | 12/1992 |

(Continued)

OTHER PUBLICATIONS

International Search Report for PCT/US2009/045902 dated Nov. 11, 2009.

*Primary Examiner* — Atul P. Khare

(74) *Attorney, Agent, or Firm* — Levenfeld Pearlstein, LLC

(57) ABSTRACT

The present invention pertains to a heat transfer label that can be modified by an end user in order to indicate variable data prior to transfer of the heat transfer label to a substrate. The label can include fixed data and a region where the variable data is provided or applied and through which the data is viewed when the label is affixed to an object or item. A method for marking the variable data or graphic into the heat transfer label includes punching holes through, or selectively removing ink from, an area of ink located on the heat transfer label tape or strips. The blocks of inked areas are punched or the ink is removed from portions of the block inked area to form a pattern or code correlating to the variable data or graphic and may be configured to be read by human or machine.

11 Claims, 3 Drawing Sheets

(56) References Cited

U.S. PATENT DOCUMENTS

| | | | |
|---|---|---|---|
| 7,021,549 | B2 | 4/2006 | O'Rell et al. |
| 2003/0035933 | A1 | 2/2003 | Stahl |
| 2005/0136227 | A1 | 6/2005 | Baldwin et al. |
| 2005/0136229 | A1 | 6/2005 | Baldwin et al. |
| 2008/0063863 | A1 | 3/2008 | Colella et al. |

FOREIGN PATENT DOCUMENTS

| | | |
|---|---|---|
| EP | 0689948 | 1/1996 |
| FR | 2369639 | 5/1978 |
| GB | 2187023 | 8/1987 |
| WO | 03018700 | 3/2003 |

* cited by examiner

HEAT TRANSFER LABEL VARIABLE DATA INDICATOR AND METHOD OF MAKING SAME

CROSS-REFERENCE TO RELATED APPLICATIONS

This application claims the benefit of priority of Provisional U.S. Patent Application Ser. No. 61/059,545, filed Jun. 6, 2008, entitled "HEAT TRANSFER LABEL VARIABLE DATA INDICATOR AND METHOD" and of Provisional U.S. Patent Application Ser. No. 61/138,605, filed Dec. 18, 2008, entitled "MARKING PROCESS FOR VARIABLE DATA".

BACKGROUND OF THE INVENTION

The present invention is directed to heat transfer labels. More particularly, the present invention relates to markable heat transfer labels that contain fixed and variable regions and are applied to articles to provide unique markings, and methods for making such markings.

Data and graphics-containing labels are in widespread use in most every industry. Labels are used to mark products and typically include both fixed and variable data. For example, fixed data can include the manufacturer's name, location, and instructions, while variable data may include the size of the product, composition of the material, model number, serial number, and/or power (voltage and ampere) requirements.

Heat transfer labels in particular are used to decorate, mark, code, and/or brand rubber products such as hoses, power transmission belts, and tires (hereafter "substrates"). Typically, heat transfer labels consist of ink color layers that adhere to substrates upon application of heat and pressure. Customers often require information such as that listed above as well as production lot data, date, and/or code information and the like (hereafter "variable data") to be incorporated into the product decoration for traceability purposes. The heat transfer label can be made with day/month/quarter/year code or any other code depending on customer preference. In many instances, such information is included in pre-printed heat transfer labels, such as those manufactured by ITW Trimark.

One drawback to the use of pre-printed labels with variable data or graphics, however, is that large inventories of completely finished pre-printed labels are needed at the manufacturing or packaging site. While this approach provides desirable information on an item-attached label, the large label inventory that is needed, in conjunction with the space necessary for storing such an inventory, makes this approach undesirable. This also increases the likelihood of label obsolescence. As such, there may well be a large quantity of completely finished labels in inventory when a product is changed or discontinued. The heat transfers then become perishable items that cannot be used after the specific date or time-period pre-printed on the heat transfer has lapsed. As it is extremely difficult for customers to pre-determine their exact requirements, existing practice inevitably leads to significant quantities of un-used heat transfer labels being disposed of at considerable cost.

Accordingly, there is a need for a variable data heat transfer label that provides the flexibility to mark variable data or graphics on site, e.g., modify data or graphics on site, immediately prior to applying the label to the product substrate. Such heat transfer labels would be easy to modify and be non-perishable for date or code reasons. Desirably, such a label includes some manner of fixed data and a modifiable region in which the variable data is provided and through which the data is viewed when the label is affixed to an object or item.

BRIEF SUMMARY OF THE INVENTION

A method for making a modifiable heat transfer label includes providing a support surface, a portion of the support surface having a modifiable area for data and/or graphics and removing, selectively, portions of the modifiable area of the support surface such that a substrate is visible through the selectively removed portions of the heat transfer label. The support surface includes a portion for fixed data and/or graphics. The modifiable area is an ink-coated area. The modifiable area is punched and/or etched manually and/or by programmable machine. The label is positioned on a substrate and a substrate is visible through the modifiable area. Another method for making a modifiable heat transfer label includes providing a first support surface, a portion of the support surface having a modifiable area for data and/or graphics, providing a second support surface, pressing the first support surface and the second support surfaces together, wherein the modifiable area of the first support surface is adjacent to the second support surface, providing a heat press, heat die or other form of energy transfer in the shape of data and/or graphic against the two support surfaces to selectively transfer portions of the modifiable area in the shape of the data and/or the graphics to the second surface, and separating the second support surface from the first support surface. The second supporting substrate is an over-laminate. The over-laminate is coated with a composition to facilitate adherence to the modifiable area of the first supporting surface when the over-laminate is exposed to heat or is of a material that is receptive to the ink. A heat transfer label made using the methods disclosed includes a supporting substrate, the supporting substrate having a region of fixed data and a modifiable region, the modifiable region including a removable ink coating over the supporting substrate.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
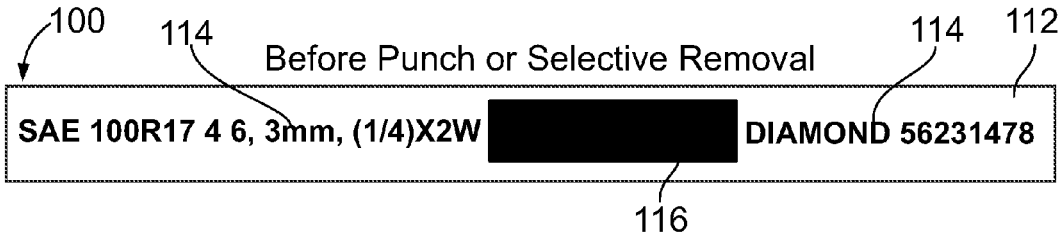
FIG. 1 is a bottom view of a heat transfer label having a solid block of ink.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

The present invention pertains to a heat transfer label, and a method of making the same, that can be modified by an end user in order to indicate variable data, such as dates or codes, prior to transferring the heat transfer label onto a substrate. The label provides the flexibility to provide variable data or graphics on-site immediately prior to applying the label to a substrate. The label can include some manner of fixed data and a region in which the variable data is provided or applied. The variable data is viewed when the label is affixed to an object or item.

A method for marking the variable data or graphic into the heat transfer label at the end user location prior to or during use includes "punching" holes through, or selectively removing ink from, the heat transfer label tape or strips. The heat transfer label is designed to include modifiable areas, such as blocks or strips of inked areas. The modifiable areas are punched through or the ink is selectively removed (e.g., by etching or selective heat transfer) from portions of the inked area to form a pattern and/or code correlating to the data or graphic. At these modified area, no ink is transferred to the substrate and the substrate is seen through the modified area, providing a readable reverse print of the variable data or graphic. The data or graphic pattern may be configured to be read by human or machine.

Turning now to the figures, in particular FIG. 1, a heat transfer label 100 is shown. The heat transfer label 100 has a support surface 112 onto which an ink transfer 114 of fixed data or graphic is printed. In the present example, an alphanumeric fixed transfer 114 is shown; however, the transfer 114 may be a bar code or shapes in a multitude of sizes or may have no fixed data or graphic. A modifiable area 116 of, for example, a solid block of ink, for variable data or graphics is located on the support surface 112 as well. The modifiable area 116 may be repeated as many times as necessary on the support surface 112 and can be formed in a plurality of shapes.

Figure 2:
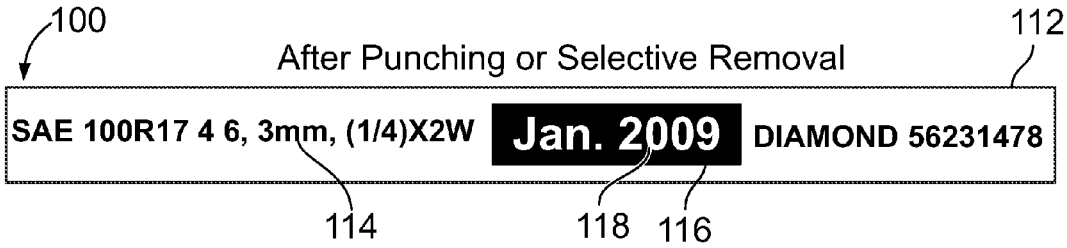
FIG. 2 is a bottom view of a heat transfer label after variable data or graphic has been punched or etched into the solid block of ink.
Figure 3:
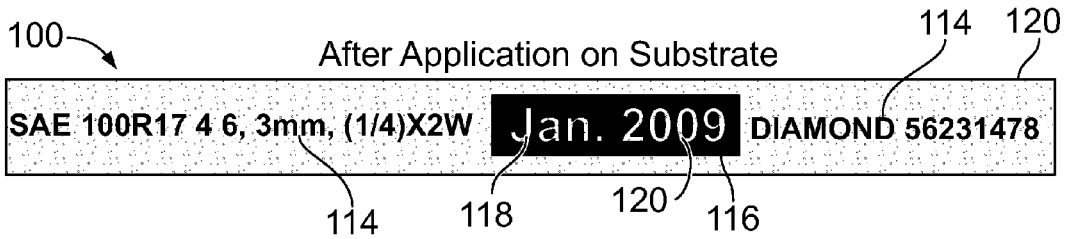
FIG. 3 is a top view of a heat transfer label as applied to a substrate with an ink portion of the label punched through, etched into, or selectively removed from the label.

An end user can insert variable or customizable information 118 onto the heat transfer label 100 (FIG. 2) prior to applying the label 100 to the substrate 120 (FIG. 3). Thus, after insertion of the variable or customizable information 118, the modifiable area 116 is selectively transparent or possesses pass-through areas wherein the substrate onto which the label 100 is positioned is visible through the modifiable area 116.

Figure 4:
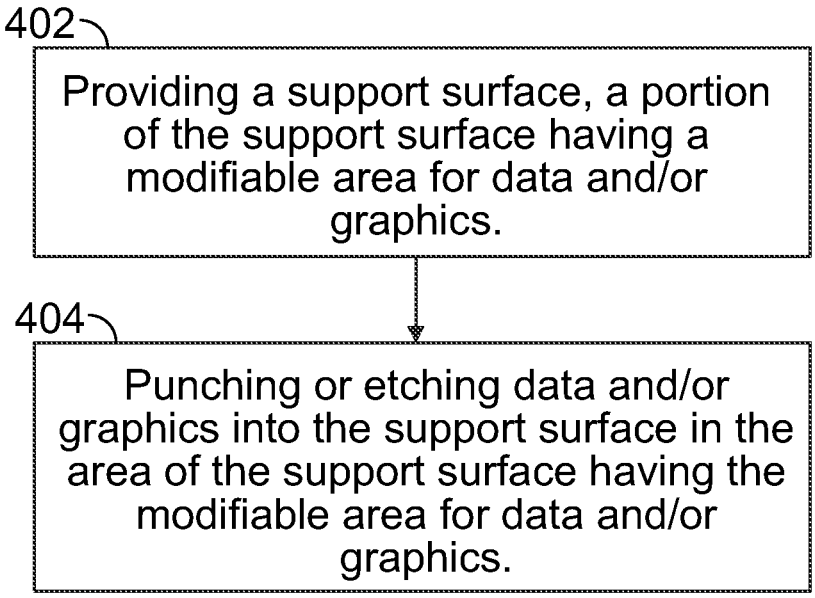
FIG. 4 is a flow chart of an embodiment of a method of making the heat transfer label.

The variable data or graphic 118 is inserted into the heat transfer label 100 by several methods herein disclosed. In a first embodiment, illustrated in FIG. 4, in conjunction with FIGS. 1-3, a surface support is provided having a modifiable area, block 402. Data and/or graphic is mechanically punched or cut through the supporting substrate at the modifiable area, block 404. A programmable punch or etching machine may be used to enter variable data or graphic 118. As the heat transfer label 100 passes through the programmable machine variable data or graphic designs 118 are punched or etched in the solid block of ink 116. Alternately, the punching/etching may be done manually with manual punch devices, scratch or by etching devices, such as lasers or knives or traditional etching tools. The format of the punched or etched area of variable data or graphic 118 can be any number of shapes and sizes including, but not limited to, alphanumeric codes, bar codes, or geometric shapes that can be read by human or machine to represent the desired variable data or graphics to be placed on the substrate 120.

The punch or etching may pass entirely through the label 100 including the support layer 112 or may remove only portions of the transfer layer 114. In either case, the substrate 120 is visible through the now transparent or partially transparent areas. In other words, the substrate 120 onto which the transfer 114 of the heat transfer label 100 is applied is visible through the punched or etched area of the solid block of ink 116 of the heat transfer label 100, as shown in FIG. 3. FIG. 3 illustrates the heat transfer label 100 having variable data 118 as applied to a substrate 120. The variable data 118, in this example "January 2009", is visible in the solid block of ink 116. It is anticipated that the variable data 118 is readable by human or by machine before or after application to the substrate 120.

In another embodiment, the ink is applied to the heat transfer label in layers such that a top layer may be removed and a second layer becomes visible or readable indicating the variable data, which is subsequently transferred to the substrate. It is anticipated that a different color ink would be readable or a different pattern would be readable, not necessarily a transparent area alone.

Figure 5:
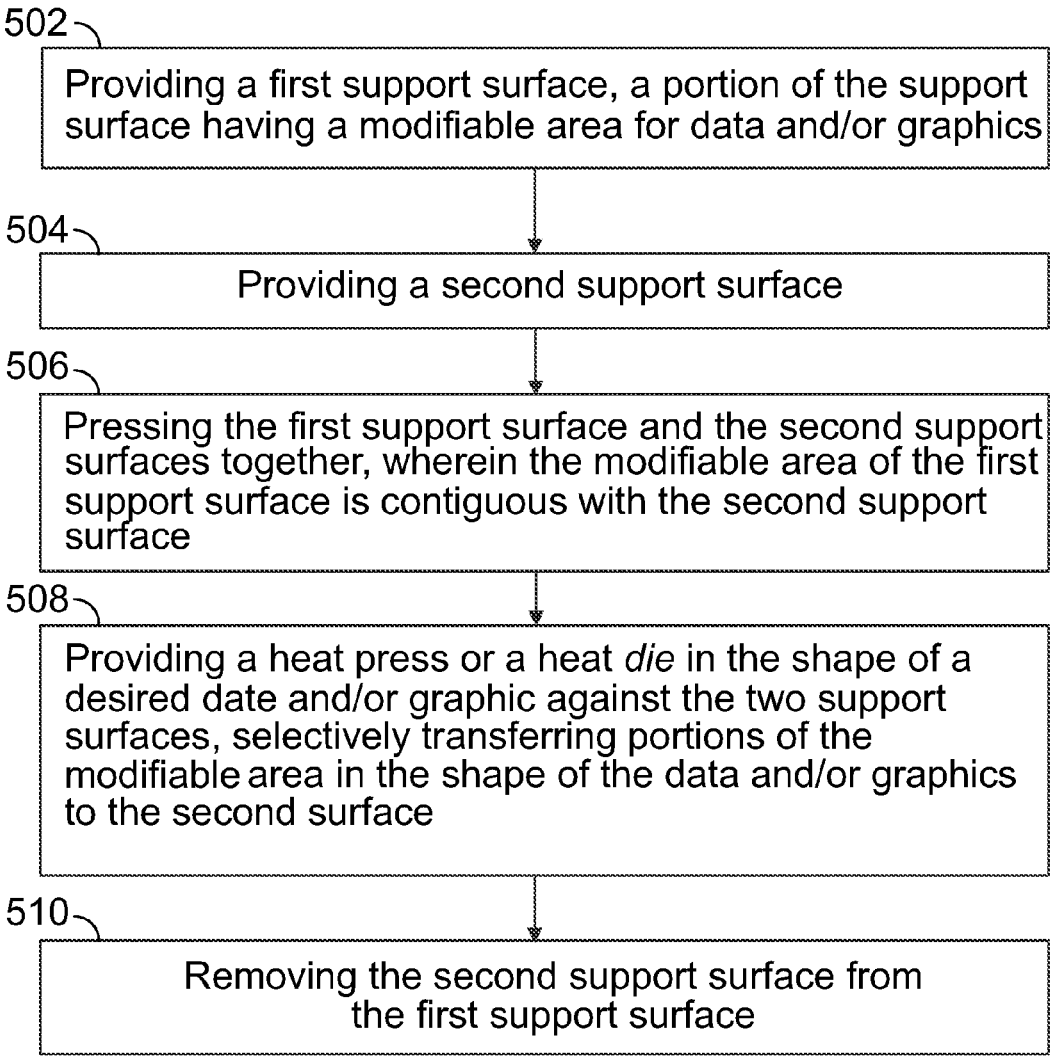
FIG. 5 is a flow chart of another embodiment of a method of making the heat transfer label.

In another embodiment, described in FIG. 5, ink is selectively removed using a second supporting surface, such as an over laminate. A first transparent supporting surface (also referred to herein as a carrier film) includes a modifiable portion, block 502. The second supporting substrate has a chemical to facilitate removal of ink from the first ribbon, block 504 or is made of a special material that is receptive to ink removed from the first ribbon, block 504. The supporting surfaces are pressed together, the ink side of the first supporting surface pressed against the second supporting surface, block 506. A heated press or heated die, or laser or other form of energy transfer, is configured with the data or graphic desired is used to heat selected portions of the ink or modifiable area on the first supporting surface, block 508. The over laminate supporting surface only attaches to areas that have been heat treated. As the second supporting surface (over-laminate) is drawn away from the first supporting substrate, the ink is selectively removed at the heat-treated areas, block 510. The over-laminate is of a material that is receptive to the ink to facilitate adherence to the ink from the modifiable area of the first supporting surface when the over-laminate is exposed to heat or other form of energy. The heat or energy transfers the selected portion of ink from the first supporting surface to the second supporting surface and the second supporting surface may then be discarded or used for other purposes. The first supporting surface then contains a modified portion having selected portions of the ink removed in the form of the desired data and/or graphic. The finished label may then be applied to the substrate.

There are several advantages to the present invention. The present invention allows end users to customize the information applied onto the substrate regardless of the quantity of items. Long print runs of standard decoration such as brand and specification information is possible. Such heat transfer labels are devoid of variable data or graphics and would, therefore, be "non-perishable". There is increased customer flexibility in that there is no need to pre-order pre-determined specific quantities and types of heat transfer labels for specific production runs. The present invention also lowers customer costs while increasing the amount of types of variable data that can be applied to the products.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method comprising:

printing at least one of a fixed data or graphic on a first portion of a first transparent support surface of a transparent heat transfer label;

coating a second portion of the first transparent support surface with a solid ink block comprising multiple ink layers, the solid ink block and the at least one fixed data or graphic contacting the first transparent support surface on one side while being open and exposed at an opposing side;

pressing a support substrate surface against the coated and printed transparent support surface, the support substrate surface either having a chemical facilitating removal of ink from the ink block or being made of a material receptive to ink of the ink block;

heat treating selected portions of the coated ink block; and drawing the support substrate away from the coated and printed transparent support surface so as to selectively remove only an exposed top ink layer of the heat treated portions, thereby defining a variable data or graphic remaining on the transparent support surface.

2. The method of claim 1, wherein the coated second portion is arranged within the fixed data or graphic.

3. The method of claim 1, wherein the support substrate is an over laminate.

4. The method of claim 1, wherein the support substrate attaches only to the heat treated portions.

5. The method of claim 1, wherein said heat treating is by a heated press, a heated die, or a laser.

6. The method of claim 1, wherein said heat treating is conducted after said pressing, and wherein the support substrate is of a material receptive to ink of the ink block so as to facilitate adherence to the ink when the support substrate is exposed to the heat treatment.

7. The method of claim 1, wherein the selective removal exposes a different color ink than that of the top layer.

8. The method of claim 1, wherein the selective removal forms a different ink pattern.

9. The method of claim 1, wherein the variable data or graphic is selected from the group consisting of alphanumeric codes, bar codes, and geometric shapes.

10. The method of claim 1, wherein the variable data or graphic is outlined by exposed top ink layer portions remaining after the selective removal.

11. The method of claim 1 further comprising positioning the heat transfer label comprising the fixed data or graphic and variable data or graphic on a substrate.

* * * * *